US008092970B2

(12) United States Patent
Tyagi et al.

(10) Patent No.: US 8,092,970 B2
(45) Date of Patent: Jan. 10, 2012

(54) ADJUSTABLE GLOSS DOCUMENT PRINTING

(75) Inventors: Dinesh Tyagi, Fairport, NY (US); Yee S. Ng, Fairport, NY (US); Mark C. Zaretsky, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 830 days.

(21) Appl. No.: 12/152,498

(22) Filed: May 15, 2008

(65) Prior Publication Data

US 2009/0286177 A1 Nov. 19, 2009

(51) Int. Cl.
*G03G 5/00* (2006.01)

(52) U.S. Cl. ..... 430/124.1; 430/123.5; 430/123.52

(58) Field of Classification Search ..... 430/124.1, 430/123.5, 123.52
See application file for complete search history.

(56) References Cited

U.S. PATENT DOCUMENTS

| | | | |
|---|---|---|---|
| 4,546,060 | A | 10/1985 | Miskinis et al. |
| 6,754,457 | B2 | 6/2004 | Ciaschi et al. |
| 6,766,136 | B2 | 7/2004 | Jadwin et al. |
| 6,909,856 | B2 | 6/2005 | Crichton |
| 7,139,521 | B2 | 11/2006 | Ng et al. |
| 2001/0051057 | A1 | 12/2001 | Tomita |
| 2005/0135851 | A1 | 6/2005 | Ng et al. |

FOREIGN PATENT DOCUMENTS

| | | | |
|---|---|---|---|
| EP | 1 333 330 | A1 | 8/2003 |
| JP | 09 166901 | A | 6/1997 |

*Primary Examiner* — Mark Chapman
(74) *Attorney, Agent, or Firm* — Donna P. Suchy

(57) ABSTRACT

A method and system for printing adjustable gloss image documents using a variety of toners where some toners have a relatively low melt viscosity and others have a relatively high melt viscosity. These toners are co-printed prior to fixing, on the receiver proximate to and overlying at least a portion of each other.

24 Claims, 10 Drawing Sheets
(1 of 10 Drawing Sheet(s) Filed in Color)

ADJUSTABLE GLOSS DOCUMENT PRINTING

FIELD OF THE INVENTION

The present invention relates generally to printing documents with image elements and, more particularly, to a method and apparatus for printing adjustable and variable gloss image elements within a document to create an adjustable gloss image document and method.

BACKGROUND OF THE INVENTION

Printing technologies, such as electrophotography (EP), have become more and more capable of reproducing pictorial subject matter, particularly when using three or four colors in addition to a clear toner, so that now users often desire to print textural material, graphics and/or pictorial subject matter requiring a glossy look and feel. Professional print shops produce documents such as brochures, certificates, pamphlets, and the like, with spot gloss or spot varnish. This treatment can be a regional or image-wise coating of clear ink or toner.

To meet the proper image quality in today's market, control of the image gloss, luster and other surface finishes has become more important. These users require the ability to adjust the media surface gloss continuously and as closely as possible to result in the gloss level and coverage needed to satisfy end user demands. The differences between high (glossy) photo quality gloss, medium graphic arts quality gloss, and low (matte) text quality gloss are large and the gloss levels between have been unattainable using prior art printers and current printing methods. Furthermore, there is the need to adjust the gloss level not only from one print job to another, or from one page to another, but also within a page.

A solution has been found to meet this need. Using a different toner such as a high viscosity toner in combination with four-color printing using lower viscosity toners allows the user to obtain an adjustable gloss, even within a printed page.

SUMMARY OF THE INVENTION

The present invention provides an electrophotographic printing method, which produces a gloss level on image documents that is adjustable using a mixture of two or more types of toner having different properties.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

DETAILED DESCRIPTION OF THE INVENTION

The preferred embodiment of this invention will be described in connection with an electrographic printer, by way of example, because this invention is contemplated to be particularly beneficial in such an application. It will be appreciated by those skilled in the art having reference to this specification that this invention can also be used in any type of electrographic system, of any size or capacity or other printer or image processor that has good registration between colors and some software for color correction and process control, but it could be used on any multi-color printer with good registration. As such, this description is provided by way of example only, and is not intended or contemplated to limit the true scope of the invention as claimed. For prints that require the look and/or feel of any type of gloss the use of a relatively high viscosity toner, such as the Kodak adjustable gloss toner, but not limited to that formulation, in conjunction with the print engines that perform four color printing, allows the user to obtain a totally adjustable gloss that can vary from a high gloss to a low gloss, or matte, finish. The adjustable gloss image elements are obtained by laying down, in a variety of combinations, both the relatively high and the relatively low viscosity toners. The relatively high viscosity toners may, for example, be formulated as either black or clear, and may be used in various combinations with the more standard relatively low viscosity black, CMY (cyan, magenta and yellow) and clear toners currently used in the Kodak NexPress printers.

Figure 1:
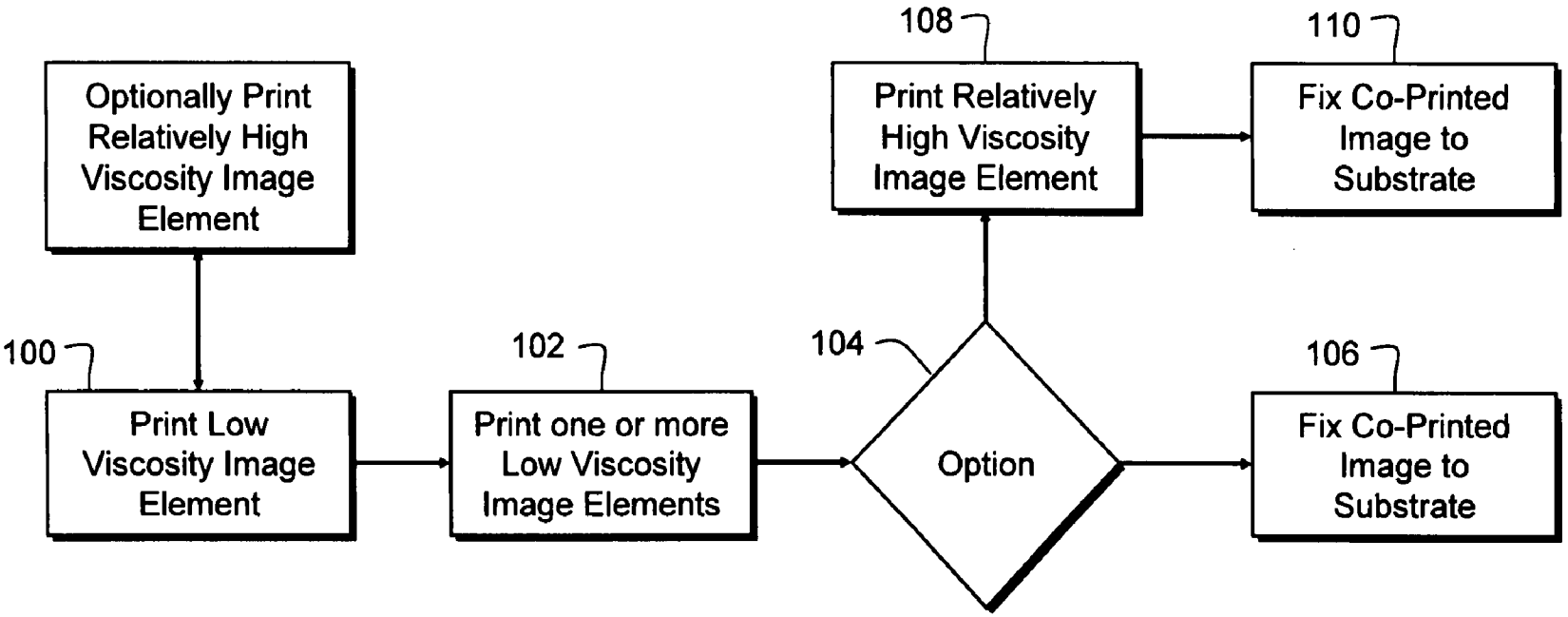
FIG. 1 presents a flow chart of the inventive printing process and system.

In order to provide a general context for the preferred embodiments of the invention, FIG. 1 shows a flow chart of one exemplary method for use in a related system for printing adjustable gloss image documents as the invention is contemplated. Although described in reference to an electrophotograghic printer, this invention will be applicable to a wide range of printing machines. The method, according to one preferred embodiment of the invention, starts with selecting a toner characteristic, in this case viscosity, for printing at least two image elements, as shown in steps 100 and 108, while also printing other image elements on a receiver 102. Step 100 in this embodiment is shown having a first viscosity that is a relatively low viscosity in comparison to the second image element 108, which is shown having a relatively high viscosity. Other image elements are shown having the same viscosity as the first image element and are shown as printed between 100 and 108 but could be also printed before or after both 100 and 108, as will be discussed below.

In this embodiment step 100 occurs in the first print engine followed by CMY color print engine printing 102 and an optional black that could have either a low or high viscosity toner and finishing with step 108 in the fifth or sixth or higher print station, shown here as the last station. The receiver could be a non-printed or a preprinted receiver of any composition that would receive the toner including paper, metal, cloth, wax, etc as well as material combinations. Determining to print this last station is represented by step 104 with the fusing and finishing steps represented by 106 and 110. Finishing can include fixing by heat and/or pressure as well as UV radiation, IR radiation, solvent or any other fixing method. The controller required for this technique would be required to determine print parameters as well as possibly to select the amount of toner to be used from the last toner station as the viscosity of that toner is the characteristic that will determine the final gloss level. The gloss level could be a variable, or adjustable subject to customer wishes, or a default gloss between 5 (low gloss) and 50 (high gloss). Various combinations could require the appropriate software to parse the characters for their color treatment and mixture of high and low viscosity toner either at the bit map level or before.

Figure 2:
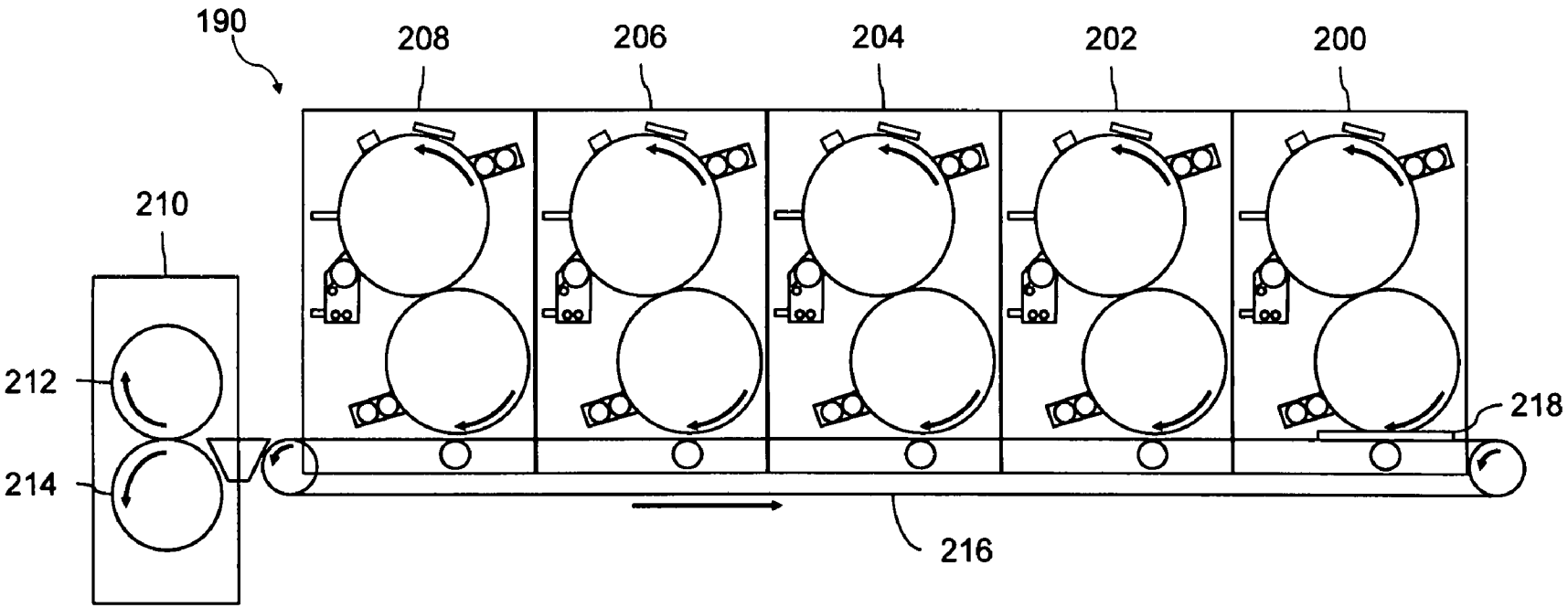
FIG. 2 presents a schematic diagram of an electrographic marking or reproduction system in accordance with the present invention.

FIG. 2 shows a schematic of a device 190, also referred to as a printing device, used for printing the image elements. The device 190 includes a plurality of imaging modules 200, 202, 204, 206, and 208. Each of these imaging modules may apply toner image elements on the receiver 218. An example of the device 190 shown in FIG. 2 would be the NexPress S3000 digital printer sold by Kodak NexPress Solutions, Inc. In a preferred embodiment, low viscosity toner image elements are first applied to the receiver by image modules 200, 202, 204, and 206 and a relatively high viscosity toner image element (the viscosity chosen to achieve the desired final gloss level), is applied in the final imaging module that in FIG. 2 is indicated by 208 but could be a sixth sprint engine or a second, third or fourth print engine depending on the printing machine and print development. Also shown in FIG. 2 are fixing members 212 and 214 and belt 216, that transports receiver 218 and will be discussed in more detail below.

In one preferred implementation, the low viscosity toner will have a viscosity of between 1,000 (1 kP) and 20,000 poise (20 kP) and a dissipation/loss factor (tan delta) of between 1 and 30 where tan delta is defined as the ratio of the loss modulus to the elastic modulus of the toner as measured at 120 C on a parallel plate rheometer. The low viscosity toner could further have a viscosity between 2,000 (2 kP) and 10,000 (10 kP) poise and a tan delta between 2 and 15. Further, the high viscosity toner used in this invention would have a melt viscosity of between 10,000 (10 kP) and 100,000 (100 kP) poise and a tan delta of between 1 and 2.5 when measured under the same measurement conditions. The toners may contain optical, UV, or IR sensitive pigments or be clear (non-pigmented), and will preferably be applied to the receiver at an optical transmission density of 0.01 to 5.00. One preferred low viscosity toner is the NexPress DryInk sold by NexPress Solutions, Inc. In some embodiments, the low viscosity toner has a melt viscosity between 2 and 10 kP to yield a G60 gloss value of more than 20 and, when combined with the high viscosity toner, can yield a G60 gloss of less than 10 such that the fixed print has a gloss differential of more than 20.

Gloss values come from measuring the percent of incident light reflected off the surface in question. The angle of incidence, along with the roughness of the surface, greatly affects the measured gloss value. For very rough/matte surfaces, an incident angle of 85 degrees is typically used. For very smooth surfaces, an angle of 20 degrees is preferred. For all of the gloss measurements reported herein a gloss measurement using a 60-degree angle of incidence is used and is sometimes referred to as a G60 value. The measurements were taken using a BYK Tri-Gloss meter. Gloss differential is defined as the difference in measured gloss between two distinct image and/or non-image areas on the print. The high viscosity toner will have some of the characteristics of the Kodak Nexpress toner detailed in U.S. Pat. No. 4,546,060, which is incorporated herein by reference. This relatively high viscosity toner will have a viscosity between 10 and 100 kP and a tan delta of between 1 and 2.5 but higher than the relatively low viscosity toner and can be a clear color or a black color or have other pigments or additives added. One preferred high viscosity toner is described in detail in U.S. Pat. No. 6,766,136, which is incorporated by reference.

Figure 3:
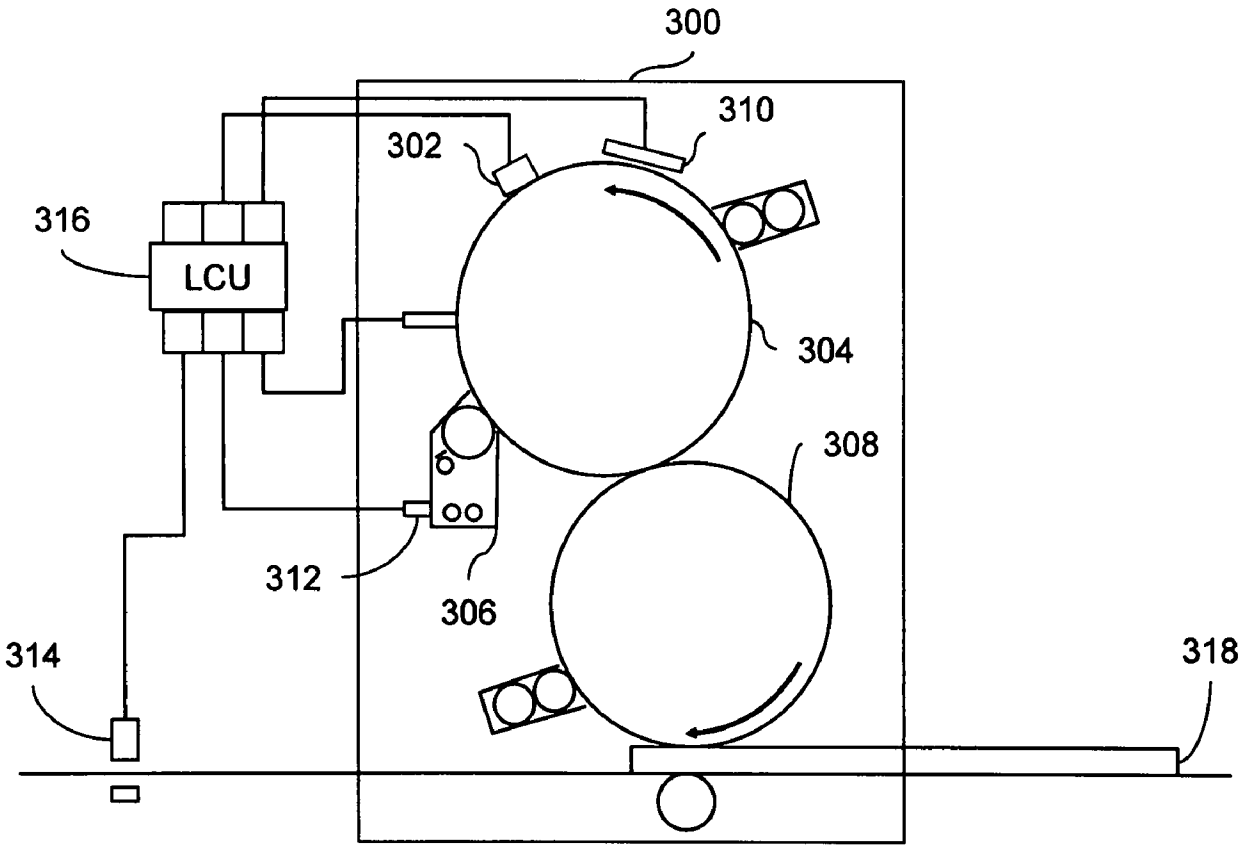
FIG. 3 presents a schematic diagram of an imaging module in an electrographic marking or reproduction system in accordance with the present invention.

A detailed schematic of one exemplary imaging engine or module, such as imaging module 200 shown in FIG. 2, is shown in FIG. 3. The imaging module 300 is used to print high viscosity and low viscosity toners on receiver 218 and includes an optical writer 302, an electrostatic charge deposition element 310, and an image forming member 304, a development station 306, a transfer member 308, a toner concentration sensor 312, an image density sensor 314, and a logic control unit 316. A uniform charge is applied to the imaging forming member 304 by the charge deposition element 310. The image elements are written in the charge layer by discharging the charged layer with focused light from the optical writer 302. Examples of this image forming process are discussed in U.S. Pat. No. 6,909,856, which is incorporated by reference.

The image elements are written by the writer to form a latent image, which is then toned by the development station 306. The development station 306 contains either the low or high viscosity toner as discussed above. High viscosity toner will have a viscosity between 10 and 100 kP and a tan delta of between 1 and 2.5 and higher than the low viscosity toner. The toner image element is then transferred to the transfer member 308 and then to the receiver 318. Subsequent imaging modules, such as 202, 204, 206, and 208 from FIG. 2, apply additional image elements to receiver 318 in a similar manner.

Referring now to FIG. 2, the image on receiver 218 with the accumulated toner image elements is fixed by heat, pressure, UV or IR radiation, solvent, or other means well known in the art. In a preferred embodiment, the image is laid down such that the first station 200 contains and deposits either a relatively low or high viscosity black toner, depending on the gloss level required. Subsequently, color stations 202, 204, and 206 deposit their respective color toner layers, followed by the last station containing high viscosity (relative to the other viscosities) black or clear toner, which will lay down the appropriate amount of the high viscosity toner to achieve the desired gloss level, a sort of dialable gloss level, before being fixed via heat and pressure by fixing members 212 and 214. The preferred temperature of image fixation is between 150 and 200 C and nip dwell time from 25 to 100 milliseconds. A most preferred embodiment uses fixing temperatures between 160 C and 185 C and nip dwell times of 35 to 55 milliseconds. Fixing of the combined toner image elements results in an image element with the desired adjusted gloss level and will work on a wide range of substrates.

The high viscosity toner, such as a clear toner or black toner, can be placed in the fifth module of the printing system as, shown in FIG. 2, such as the Kodak Nexpress S3000, while the other four printing modules can be populated by the normal low viscosity C, M, Y, K toners as discussed above. A typical high viscosity toner has low gloss (G60 of roughly 5) after fusing, while the normal low viscosity polyester color toners (C, M, Y, and K) have a higher gloss (G60>20) after fusing, when printed on a glossy coated paper receiver.

This is achieved in one embodiment using a high viscosity clear toner, by first performing the after-color profile mapping of the input color to output color, knowing that the output will be represented by the higher gloss regular polyester CMYK toner. If the user wants to achieve a different gloss level, the gloss level can be adjusted by adding a higher viscosity clear toner, as described above, in an amount needed to yield the final adjusted gloss and differential gloss within the image. Of course, that adjustable gloss effect can affect more than just the printed images. After color mapping (color profile) of an output color to L*a*b*, a C, M, Y, K* output separation can be created. For example, the K* component can be mapped to a combination of high viscosity black and low viscosity black. A lookup table (LUT) that translates a lower gloss, high viscosity in combination with a higher gloss regular black toner mixture to combined black (K*) gloss can be used to tune the resulting color patch (C,M,Y,K*) gloss value, thereby given a tool to adjust the overall gloss value of the color images itself. Another aspect of this method is to get lower differential gloss overall for the images by using this gloss adjustability.

In one embodiment, adjustable gloss is achieved using a black high viscosity toner, by first performing the after-color profile mapping of the input color to output color so that the black component of the output can be represented by a combination of the lower gloss, high viscosity black toner and the higher gloss, low viscosity black toner in order to get a different gloss level than can be achieved using only either the low viscosity or the higher viscosity black toners. This adjustable gloss effect influences more than just the black-only images as the color image elements having certain amounts of the black toner component can get a similar color but different amounts of gloss, depending on the different amounts of high and low viscosity black toner applied. For example, consider a color profile mapping under which a particular color calls for 60% magenta, 50% yellow, 10% cyan and 70% black (where 100% represents the maximum toner laydown allowed by the imaging module). The 70% black may be represented by 70% high viscosity black toner, 0% low viscosity black toner, in which case the lower gloss created by the high viscosity black will affect the gloss of this color (lowering it) (case 1). On the other hand, if the 70% black is represented by 70% low viscosity black and 0% high viscosity black, then the combined gloss of this color is higher (case 2). If a mixture of high viscosity black and regular black is used (for example, 50% high viscosity black, 20% low viscosity black) on this color patch, then the gloss of this color is somewhat in between case 1 and 2 described above (case 3).

In all 3 of these cases, the color of the color patch has not changed. Rather the gloss has been adjusted through the ratio of low and high viscosity black toners to achieve an adjustable gloss with various amounts of high viscosity and regular lower viscosity black without changing the color output. It is also understood that the total amount of high viscosity and regular lower viscosity black together, do not have to be restricted to 100%. For example, a case using low viscosity rich black plus high viscosity (70% cyan, 60% magenta, 50% yellow, 100% black, 100% high viscosity black) has been printed that gives lower gloss than just rich black alone (70% cyan, 60% magenta, 50% yellow and 100% black) and both can have higher density. For example it is possible to lay down 200% of the low viscosity black ("double strike" is double density) as well as the relatively high viscosity clear or black.

Other embodiments involving both the first station 200 and the last station 208 in a five-station printer can also achieve an adjustable gloss level. A few of these embodiments include the use of the regular, lower viscosity polyester black toner in both the first and last station, yielding a high level of uniformity (high laydown) and a glossy (around a gloss level of 50) high density image. In contrast, if the regular, lower viscosity polyester black toner is used in the first station and the high viscosity black is used in the last station, this also results in a high level of uniformity (high laydown) but a matte gloss finish (gloss levels between 5-50) as the black contained in other color combinations does depress the gloss of all colors that have black in them as well as the black itself in this embodiment.

In another embodiment the high viscosity black toner is placed in the first station and the regular polyester black toner is placed in the last station yielding an "undercover removal" situation that results in high uniformity (high laydown) in the black printed areas only and not in the color areas, thus yielding a matte black (gloss between 5 and 50) users like with high gloss color for a spot matte black on the print. If the high viscosity black is placed in both the first and the last stations it will result in greater laydown uniformity since this results in high laydown areas as well as a totally matte surface (gloss 5 to 50) in all areas that have levels of the black component.

Finally, the high viscosity clear toner can be used in the fifth imaging module and will give the range of gloss for all colors if placed in the last imaging module or strategically after the color that needs the lower gloss as discussed above, and could be selectively used in other positions for specialized results. Examples of the various combinations of images that could be printed using this combination of low and relatively high viscosity toners are illustrated below. These will allow the user to choose a desired adjusted gloss finish after fusing that will range from a gloss near 50 using low viscosity toners to a low gloss (matte) near 5 using the high viscosity toner. In certain circumstances these two could be used in the same print and would yield anything between these extremes as well as a differential gloss on the same print of around 45, which is readily observable by a user, as a differential of around 20 to 40 is the minimum difference for spot gloss.

Figure 4:
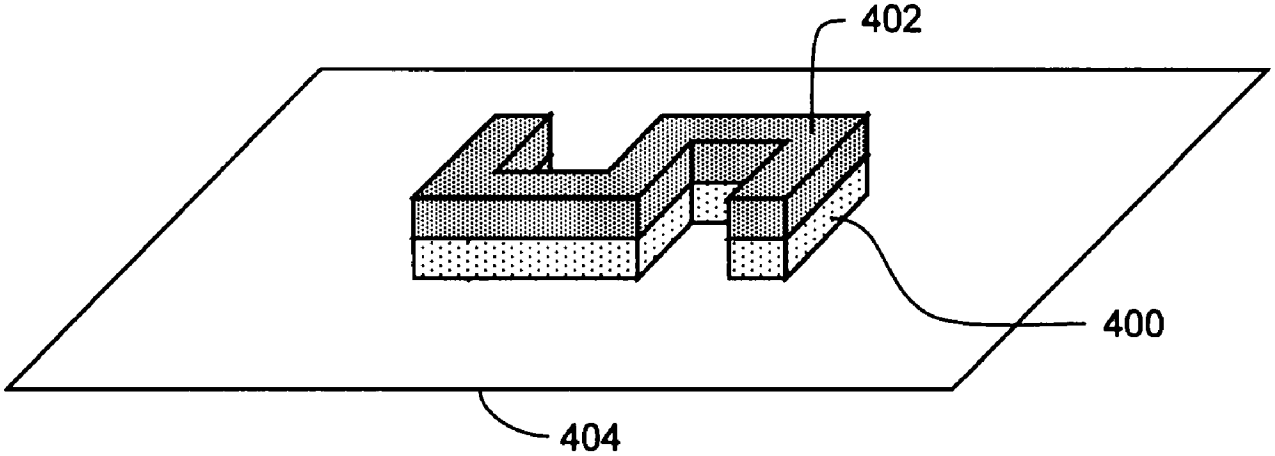
FIG. 4 presents a diagram of a printed character composed of toner image elements in accordance with the present invention

Referring now to FIG. 4, one or more first toner image elements 400 are printed on the receiver 404 and subsequently overprinted in whole or in part with second toner image elements 402. In this preferred embodiment, the first toner image elements 400 have a first characteristic, here a first relatively low viscosity. The second toner image elements 402 have a second characteristic, a second relatively higher viscosity, and these second toner image elements can exceed the sides of the first toner image element, even creating a halo effect on one part of the first image element. After fusing by heat and pressure the second toner image elements change the final gloss of the fused print. For example, if printed alone, the inherently high viscosity and elasticity of the second toner would preferentially fix to a matte finish. Alternatively, if a lower viscosity, less elastic, second toner was used for the second image element, the overprinted toner would finish as a highly glossed finish. To adjust these gloss levels incrementally between a high gloss finish and a matte finish, the relatively higher viscosity second toner 402 can have the viscosity varied and/or the amount of toner laid down varied digitally. This viscosity could be either held to tight standards or allowed to slightly vary if the demand for gloss was not very exact. Note that an aspect of document security is realized when attempts to alter the content of the first toner image elements create a change or discontinuity in the apparent gloss of the altered first/second toner image element composite.

Figure 5:
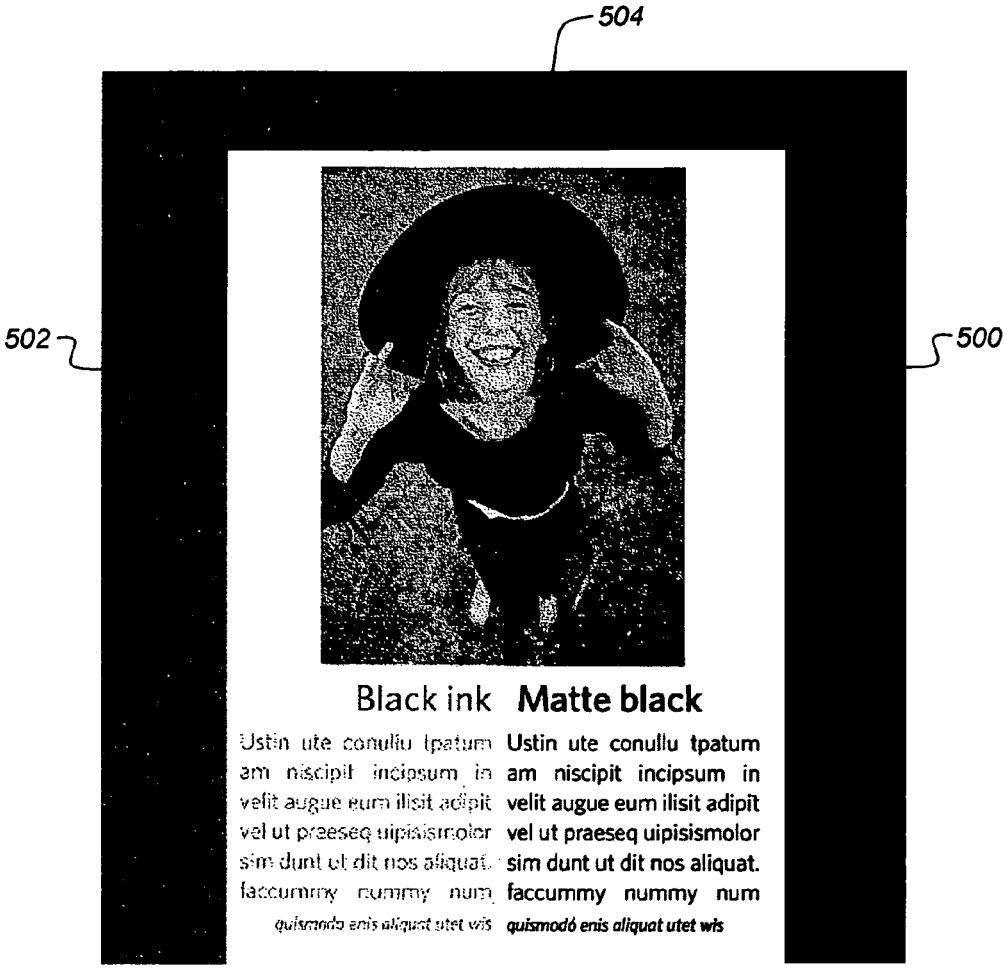
FIG. 5 presents a gloss image document in accordance with the present invention.

FIG. 5 illustrates the result of the laydown described in conjunction with FIG. 4 where the left hand side 502 is a glossy rich black formed from layers of relatively low viscosity CMYK toner and the right hand side 500 is a matte rich black due to a topmost layer of relatively high viscosity toner deposited on the previously deposited layers of low viscosity CMYK. The high viscosity toner may or may not contain optical, UV, or IR pigments. The second toner image elements will also be applied to the receiver at an optical transmission density of 0.01 to 5.00. Fixing of the combined first and second toner image elements results in an image element with the desired image gloss and differential gloss and improved adhesion to a wide range of substrates.

Figure 6:
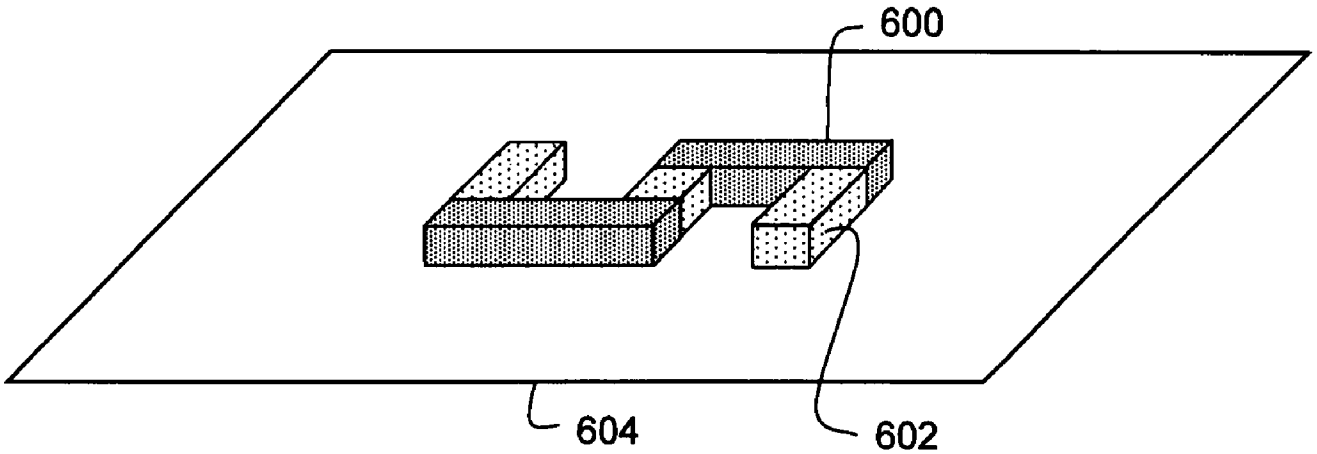
FIG. 6 presents a diagram of a printed character composed of toner image elements in accordance with the present invention.

Referring now to FIG. 6, the second low viscosity toner image elements 600 are printed adjacent to the first high viscosity toner image elements 602 on the receiver 604 and the co-printed image is fixed by heat and pressure. First and second image elements are printed beside one another such that neither the first nor the second image elements extend over the other. The resulting co-printed and fixed image contains both first and second toner but would appear to be composed of second toner only. Furthermore, the first and second image elements may be arranged in such a way as to encode information, such as with high viscosity toner, which could be decoded at the point of use to determine authenticity.

Figure 7:
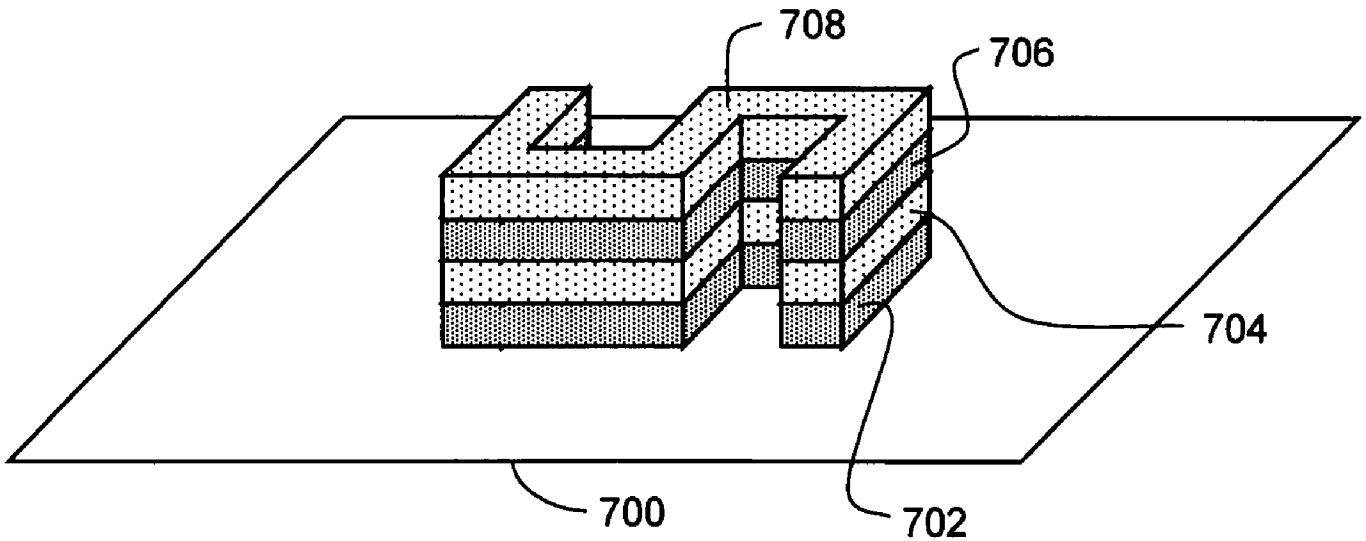
FIG. 7presents a diagram of a printed character composed of toner image elements in accordance with the present invention.

Referring now to FIG. 7, substrate 700 is a rough paper receiver having a low gloss level of around 8. Using this receiver in combination with the color profile mapping appropriate for this receiver yields printed and non-printed areas having a high gloss differential. The relatively lower viscosity (higher gloss at around 50) regular toner used to print the images will result in a gloss differential of around 42, which is well within a noticeable range of over 40 gloss units used for spot gloss and could be objectionable to the user. If the high viscosity clear toner is applied to the non-image areas of the rough paper, then the gloss differential of the total print, between the image and non-image areas, would be lowered to around 10, which is undetectable by the user. Alternatively, this could be varied by applying different amounts of a high viscosity clear toner yielding an adjustable gloss with various amounts of high viscosity clear toner on the image and or non-image areas of the receiver. In a similar manner, the gloss can be increased or reduced to achieve the desired gloss on any type of paper (glossy to rough), in combination with any color and in non-image areas, including the back of the receiver. It is also understood that the total amount of high viscosity toner and regular lower viscosity toner together, do not have to be restricted to 100%. So both can have higher densities.

FIG. 7 also illustrates that if adhesion is difficult for a high viscosity toner that is to be printed nearest the receiver, as often is the case for some specialized substrates, in which a matte finish is desired, then the first layer printed on the substrate is a clear coat of low viscosity toner, such as 10 kP viscosity, 702 to help with adhesion. This first layer of toner can then be overprinted with one or more layers of high viscosity toners, 704, 706, and 708. This improves adhesion of the first toner while also achieving the results desired without altering the image and, if desired, provides the adjustable gloss between a high gloss and a matte surface. This toner stack can furthermore be overprinted with other layers of toner to impart a variable degree of gloss to the otherwise matte image that would result from the high viscosity toner. Using the scheme shown in FIG. 7, many degrees of gloss can be imparted to the image by mixing various amounts and coverage of the low and high viscosity toners as discussed above. The result of this toner layering is a well-adhered first toner with the adjustable gloss finish.

Figure 8:
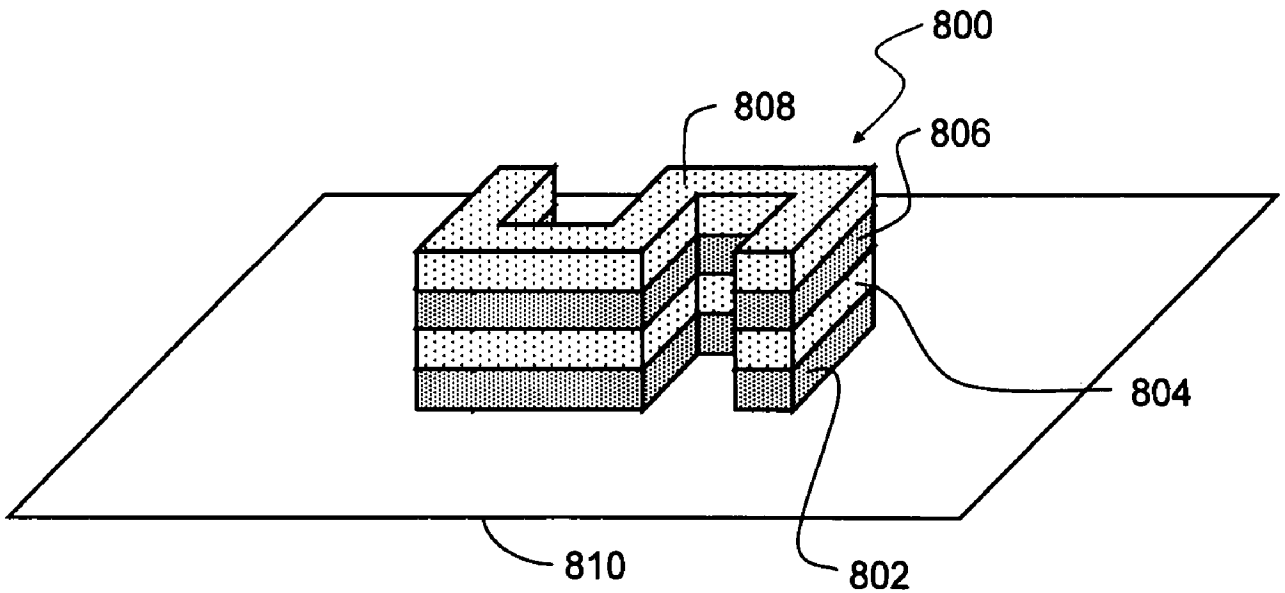
FIG. 8 presents a diagram of a printed character composed of toner image elements in accordance with the present invention.

Referring now to FIG. 8, the first relatively low viscosity toner 802 can be first printed on the substrate 810 and further overprinted with one or more layers of high viscosity first 804 or second toner 806. Over the final layer of high viscosity toner 806 can furthermore be printed a layer or partial layer of second low viscosity toner 808 to impart a desired degree of gloss to the image. Lower coverage of the low viscosity toner will result in low gloss to the image while higher coverage of the low viscosity toner will result in a higher image gloss. Furthermore, the image elements 800 are fixed at a single temperature and pressure.

Figure 9:
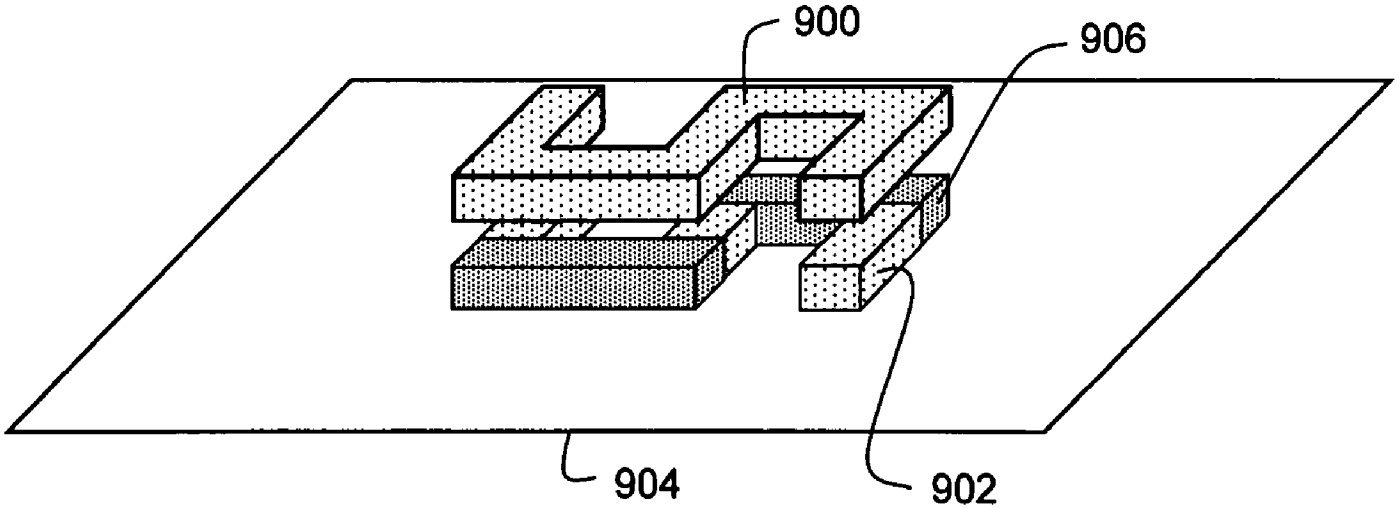
FIG. 9 presents a diagram of a printed character composed of toner image elements in accordance with the present invention.

Referring now to FIG. 9, differential toner can also be applied in a spot manner onto the image as shown in FIG. 9 where first relatively high viscosity toner image elements 902 and second relatively low viscosity toner image elements 906 are applied adjacent to one another on a substrate 904. The arrangement of these toner image elements may also produce a pattern that can be read via magnetic, optical, IR, UV or other methods known in the art. However, if the high viscosity first toner image elements 902 are printed next to low viscosity toner image element 906, a differential gloss will appear in the image. If there is a reason this is not desired then an overcoat 900, as illustrated in FIG. 9, is applied by overprinting the first and second image elements with either a low or high viscosity toner 900 such that the total image is fixed to a uniform gloss level.

The method of generating adjustable gloss image documents by selecting one or more high viscosity black or clear toners such that the first toner is used to print the first image element and the second toner, having a relatively high melt viscosity between 10 and 100 kP, is used for the second image element such that the final print has a G60 gloss less than 10. This method can be used to adjust the gloss differential on the final print to more than 20 by combining between 1 and 80 percent low viscosity toner that yields a G60 gloss of more than 20 with a high viscosity second toner between 20 and 100 percent.

In one embodiment the high viscosity black or clear toner is printed first and the second high viscosity black or clear toner is printed last to yield a highly uniform matte surface with gloss levels from 5 to 20 in colored prints. This printing can be on a pixel-by-pixel basis for both the first toner and the second toner such that the second toner covers a larger area than the first toner and could involve other colors. It should be noted that in this example of an EP printer the first print engine prints the lower image layer and the last the upper layer but there are other print engines that actually reverse this sequence and one skilled in the art would understand that in those printers the last toner would actually need to be placed in the first print engine so that it was the last layer laid down and the first would also have to be in the appropriate print engine to be printed first or at the relative positions described above.

In practice, one can use different amounts of variable viscosity clear toner to adjust for lower differential gloss as an intelligent coating solution. This intelligent coating solution can achieve a much higher (darker) density than the current methods by using the two blacks of different viscosity in the same print (high viscosity and regular black). Thus this invention and the related method can create larger gamut and the adjustable gloss at the same time.

Figure 10:
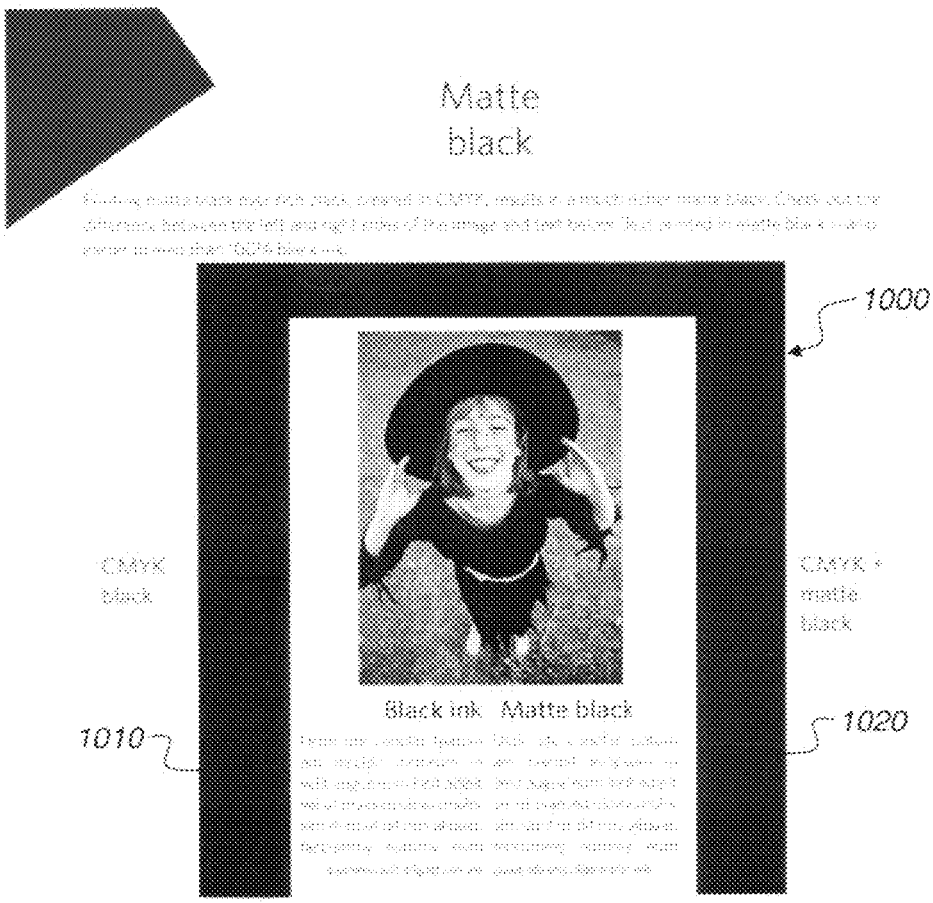
FIG. 10 presents a diagram of a print composed of toner image elements in accordance with the present invention.

In the embodiment shown in FIG. 10, there is a print 1000 with half of the page (photo and text) printed Rich Black 1010 only and half 1020 printed with Rich Black plus Matte, created using a combination of rich black plus high viscosity black toner (70% cyan, 60% magenta, 50% yellow, 100% black, 100% high viscosity black) laid down on a print 1000. One side 1020 of the print achieves a lower gloss than just rich black alone (70% cyan, 60% magenta, 50% yellow and 100% black) and also a higher density then the other side 1010. This was achieved on the one side as follows using a Rich Black (CMYK) plus Matte Black (high viscosity black):

Cyan 70%
Magenta 60%
Yellow 50%
Black 100%
High viscosity black 100%

The adjustable gloss image document is printed with a first relatively low viscosity toner printed on the receiver and the second or last toner, having a relatively high melt viscosity between 10 and 100 kP, resulting in a G60 gloss less than 10 after fixing. For example, the second toner can be a black or clear toner with a melt viscosity between 10 and 100 kP to yield a gloss of G60 less than 10 such that the fixed print has a gloss differential more than 20. The final print can have the gloss level pre-adjusted to yield a G60 gloss between 10 and 50 such that the fixed print has a gloss differential more than 20.

The adjustment in one embodiment is made by combining between 1 and 80 percent low viscosity toner that yields a G60 gloss of more than 20 after fixing, with the high viscosity second toner in an amount between 20 and 100 percent. In one embodiment this is accomplished by printing the first image element in the first print engine with the regular black toner and the second toner printed in the last print engine with a high viscosity black or clear to yield a highly uniform matte surface with gloss levels from 5 to 50 in colored prints. The second image element application and amount can be adjusted to yield a post-fixed gloss differential that is not observably distinct and indistinguishable and the adjustment can be used to correct any observed differences. The gloss differential can also be adjusted on a print by adjusting the ratio of high viscosity toner to low viscosity toner. In one embodiment that ratio would be equal to between 2 and 50 to yield a variable surface. A ratio over 1 would be a matte surface and a ratio below 1 would have a small incremental change to the gloss.

The invention has been described in detail with particular reference to certain preferred embodiments thereof, but it will be understood that variations and modifications can be effected within the spirit and scope of the invention.

What is claimed is:

1. A method of generating adjustable gloss image documents comprising:

a. selecting a first toner for a first image element and second toner for a second image element such that the second toner has a relatively high melt viscosity between 10 and 100 kP that will yield a G60 gloss less than 10;
b. printing the first toner on a receiver;
c. coprinting the second toner, prior to fixing, on the receiver proximate to and overlying at least a portion of the first toner; and
d. fixing the toners on a receiver.

2. The method of claim 1, the second toner further comprising one or more high viscosity black or clear toners.

3. The method of claim 1, adjusting the gloss differential on the print to more than 20 by combining between 1 and 80 percent low viscosity toner that yields a G60 gloss of more than 20 with high viscosity second toner between 20 and 100 percent.

4. The method of claim 1, adjusting the gloss differential on the print by adjusting the ratio of high viscosity toner to low viscosity toner to be equal to between 2 and 50 to yield a variable surface.

5. The method of claim 1, the low viscosity toner having a melt viscosity between 2 and 10 kP to yield a gloss of G60 more than 20 and the high viscosity second toner yields a gloss of G60 less than 10 such that the fixed print has a gloss differential of more than 20.

6. The method of claim 3, the first toner for a first image element being a regular black printed first and second toner for a second image element being a high viscosity black printed last to yield a highly uniform matte surface with gloss levels from 5 to 50 in colored prints.

7. The method of claim 1, the first toner for a first image element being a high viscosity black printed first and second toner for a second image element is a high viscosity black printed last to yield a highly uniform matte surface with gloss levels from 5 to 20 in colored prints.

8. The method of claim 1, the first toner for a first image element being a high viscosity clear printed first and second toner for a second image element being a high viscosity clear printed last to yield a highly uniform matte surface with gloss levels from 5 to 20 in colored prints.

9. The method of claim 1 further comprising printing on a pixel-by-pixel basis both the first toner and the second toner such that the second toner covers a larger area than the first toner.

10. The method of claim 1, the first toner for a first image element being a relatively low viscosity black printed first at 100 percent, then relatively low viscosity cyan, yellow and magenta printed as needed to form the non-black image before printing a second high viscosity clear at 100 percent to yield a highly uniform matte surface with gloss levels from 5 to 20 in colored prints.

11. The method of claim 1, the first toner for a first image element being a relatively low viscosity black printed first at 100 percent, then cyan, yellow and magenta printed as needed to form the non-black image before printing a second high viscosity clear to yield a highly uniform matte surface with gloss levels from 5 to 50 in colored prints.

12. An adjustable gloss image document comprising:

a receiver;
a first image element comprising a first relatively low viscosity toner printed on the receiver; and
a second image element comprising a second toner such that the second toner has a relatively high melt viscosity between 10 and 100 kP co-printed on the receiver proximate to and overlying at least a portion of the first toner prior to fixing, that will yield a G60 gloss less than 10 after fixing.

13. The document of claim 12, the second toner further comprising one or more of black or clear toners including high viscosity toner comprising a melt viscosity between 10 and 100 kP to yield a gloss of G60 less than 10 such that the fixed print has a gloss differential more than 20.

14. The document of claim 12, the final print further comprising a G60 gloss adjusted between less than 10 to over 20 such that the fixed print has a gloss differential more than 20.

15. The document of claim 12, the final print further comprising a G60 gloss differential on the print of more than 20 such that the adjustment combines between 1 and 80 percent low viscosity toner that yields a G60 gloss of more than 20 with high viscosity second toner between 20 and 100 percent.

16. The document of claim 12, further comprising first toner for a first image element a regular black printed first and second toner for a second image element is a high viscosity black printed last to yield a highly uniform matte surface with gloss levels from 5 to 20 in colored prints.

17. The document of claim 12, further comprising first toner for a first image element a high viscosity black printed first and second toner for a second image element is a high viscosity black printed last to yield a highly uniform matte surface with gloss levels from 5 to 50 in colored prints.

18. The document of claim 12, further comprising first toner for a first image element a high viscosity black printed first and second toner for a second image element is a high viscosity clear printed last to yield a highly uniform matte surface with gloss levels from 5 to 20 in colored prints.

19. The document of claim 18 further comprising overlying one toner over another toner pixel-by-pixel such that the one toner creates a halo by extending beyond a portion of the other toner.

20. The document of claim 12 further comprising comparing the first image element gloss to the second image element gloss to make sure not observably distinct and adjust to make indistinguishable and adjusting an amount of high viscosity toner to correct and observed differences.

21. The document of claim 12 wherein the first toner comprises a density equal to or greater than that of the second toner.

22. A method of generating adjustable gloss image documents comprising:

e. printing a relatively low melt viscosity first toner for a first image element and on a receiver with a first toner on an area prior to fusing;

f. co-printing a second toner for a second image element proximate the first image element such that the second toner has a relatively high melt viscosity between 10 and 100 kPe that will yield a G60 gloss less than 10 after fixing; and g. selecting the percent of the first toner and the percent of second toner to produce a desired final image element color such that the combination of the first toner image element color and the second toner image element color are indistinguishable to an observer and has the desired gloss level; and h. fixing the toners on the final print.

23. The method of claim 22, the first and second toners further comprising one or more of a black or clear toner.

24. The method of claim 22 further comprising overlying one image element pixel-by-pixel over another image element to create the final print.

* * * * *